US005348174A

United States Patent [19]

Velicka

[11] Patent Number: 5,348,174

[45] Date of Patent: Sep. 20, 1994

[54] METAL FLEXIBLE FINGER FERRULE FOR FLANGED CONTAINER CLOSURE

[75] Inventor: Alvydas Velicka, Watertown, Conn.

[73] Assignee: Eyelematic Manufacturing Co., Inc., Watertown, Conn.

[21] Appl. No.: 4,550

[22] Filed: Jan. 14, 1993

[51] Int. Cl.[5] ..... B65D 51/18

[52] U.S. Cl. ..... 215/277; 215/357; 215/278; 220/915

[58] Field of Search ..... 215/357, 307, 319, 332, 215/354, 274, 275, 277; 220/307, 296, 352, 320, 729, 915

[56] References Cited

U.S. PATENT DOCUMENTS

| | | | |
|---|---|---|---|
| 1,609,453 | 12/1926 | Atwood . | |
| 2,723,773 | 11/1955 | Greene . | |
| 4,073,398 | 2/1978 | Schultz . | |
| 4,173,297 | 11/1979 | Pettersen . | |
| 4,251,003 | 2/1981 | Bodenmann . | |
| 4,279,353 | 7/1981 | Honma . | |
| 4,359,166 | 11/1982 | Dubach . | |
| 4,761,319 | 8/1988 | Kraus et al. | 220/307 |
| 4,773,553 | 9/1988 | Van Brocklin . | |
| 4,883,194 | 11/1989 | Fernandes | 220/307 |
| 5,018,636 | 5/1991 | Ross | 220/307 |
| 5,150,803 | 9/1992 | Cartellone | 220/307 |
| 5,176,278 | 1/1993 | Quarberg | 220/729 |

FOREIGN PATENT DOCUMENTS

| | | |
|---|---|---|
| 2708530 | 8/1978 | Fed. Rep. of Germany . |
| 2534557 | 4/1984 | France . |
| 549372 | 10/1956 | Italy . |

*Primary Examiner*—Joseph Man-Fu Moy

*Attorney, Agent, or Firm*—Ware, Fressola, Van Der Sluys & Adolphson

[57] ABSTRACT

A metal flexible finger ferrule is provided for holding a dispensing device to the top of a flanged opening of a container. The ferrule includes a plurality of flexible fingers shaped to fit ground the flange of the container and also shaped to frictionally engage a surrounding retaining collar.

5 Claims, 6 Drawing Sheets

METAL FLEXIBLE FINGER FERRULE FOR FLANGED CONTAINER CLOSURE

FIELD OF THE INVENTION

The present invention relates to a ferrule for holding a dispensing device, such as a pump, to the top of a container. More particularly, the present invention relates to a metal flexible finger ferrule which is used to secure a dispensing device, such as a pump, to a flanged opening of a container, such as a perfume bottle, without crimping the ferrule onto the container. The ferrule is designed so as to secure the pump to the neck of a bottle by force applied to the ferrule from a retaining collar forcibly slid over the ferrule. The ferrule is designed to secure the retaining collar.

BACKGROUND OF THE INVENTION

The use of metal and plastic ferrules for holding or damming a pump or other dispensing device to a container has been disclosed by the prior art. For example., U.S. Pat. No. 4,173,297 discloses a metal ferrule for clamping a pump housing to the neck of a bottle. The ferrule is clamped by crimping it onto a container neck to hold a pump housing, plunger and other related components in an assembled relation. Such a prior art device differs from the present invention in that it must be crimped on to the container which may disfigure the overall outer appearance of the container. In addition to appearance considerations, crimping processes in general add steps and expensive machinery to the dispensing container filling and manufacturing process.

U.S. Pat. No. 4,773,553 discloses an assembly for securing and sealing a dispenser to a flanged container. That patent discloses the use of a sealing collar comprised of a resilient deformable material such as polyethylene for securing and sealing a dispenser, such as a pump, to the flanged container. The sealing collar has a diameter sized to receive the sidewall of the flange, and sized to be encased by a mounting cup. The sealing collar includes a skirt portion having radially and outwardly protruding members or tabs. The sealing collar is secured to the container by the deformation of the tabs radially inwardly, beneath the flange ledge of the container, caused by the sliding movement of the mounting cup over the sealing collar. The disadvantage of this design is that the tabs do not secure the mounting cup to the entire assembly so that removal of the mounting cup is relatively easy. To prevent removal of the mounting cup, one embodiment discloses a modified mounting cup which has a groove cut on the inside diameter which is designed to receive the tabs. This design integrally locks the mounting cup in place. The drawback of this design is that it requires the additional step of creating a groove in the inside diameter of the mounting cup.

SUMMARY OF THE INVENTION

The present invention relates to a flexible finger ferrule for damping a dispensing device to a container having a flanged opening. The ferrule comprises a metal workpiece having a circular shaped surface, a central aperture therein and an outer diameter. The ferrule includes a cylindrical skirt that extends perpendicularly downward from the outer diameter of the circular surface. The skirt has a wall defined by an inside and outside diameter. The ferrule includes a plurality of flexible fingers which are formed by a plurality of circumferentially distributed longitudinal slots cut into the lower edge of the cylindrical skirt. Each of the flexible fingers includes a terminal end, a first edge and a second edge. The fingers also have plurality of transverse sharp, well defined creases extending from the first edge to the second edge including: a first transverse well defined crease proximal to the terminal end; a second transverse well defined crease proximal to the cylindrical skirt; and a third transverse well defined crease placed between the first and second transverse creases.

The plurality of transverse creases define three portions of the flexible fingers. An upper portion of each flexible finger is defined by the second transverse crease, third transverse crease, first edge and second edge. A middle portion is defined by the first transverse crease, the third transverse crease and the first and second edges. A lower portion of the flexible fingers is defined by the first transverse crease, the terminal end and the first and second edges.

The upper, middle and lower portions of the flexible fingers are arranged so that the upper portion has an inclined orientation with respect to the wall of the cylindrical skirt so that the first and third transverse crease are at a greater radial distance from a central axis of the cylindrical skirt than the wall of the cylindrical skirt. The flexible fingers are further arranged so that the middle portion has a nearly or substantially parallel orientation with respect to the wall of the cylindrical skirt, and the lower portion has a nearly or substantially perpendicular orientation with respect to the wall of the cylindrical skirt so as to place the terminal end of the flexible fingers at a greater radial distance from the central axis than the first and third transverse creases.

Deformation of the flexible fingers, by telescoping engagement of the surrounding collar, securely anchors the ferrule and the collar to the flanged container neck, sturdily resisting disassembly. No crimping or extra manufacturing operations are required.

One objective of the present invention is to provide a ferrule for securing a dispensing device to a flanged container without crimping.

Another objective of the present invention is to provide a metal flexible finger ferrule for securing a dispensing device to a flanged container and securing a decorative metal collar coveting the ferrule.

Other objects and advantages of the present invention will become apparent to those skilled in the art from the following detailed description read in conjunction with the attached drawings and claims appended hereto.

BRIEF DESCRIPTION OF THE DRAWINGS

FIG. 3 shows the actuator and decorative retaining collar of the present invention in contact with the die assembly prior to the application of pressure by the inner member of the die.

FIG. 4 shows the ferrule and decorative retaining collar after pressure has been applied on the actuator by the inner member of the die.

FIG. 5 shows the ferrule and decorative retaining collar after partial pressure has been applied on the retaining collar by the outer member of the die while the inner member of the die is held stationary.

FIG. 6 shows the ferrule and retaining collar after full pressure has been applied on the retaining collar by the outer member of the die.

DETAILED DESCRIPTION OF THE INVENTION

Figure 1:
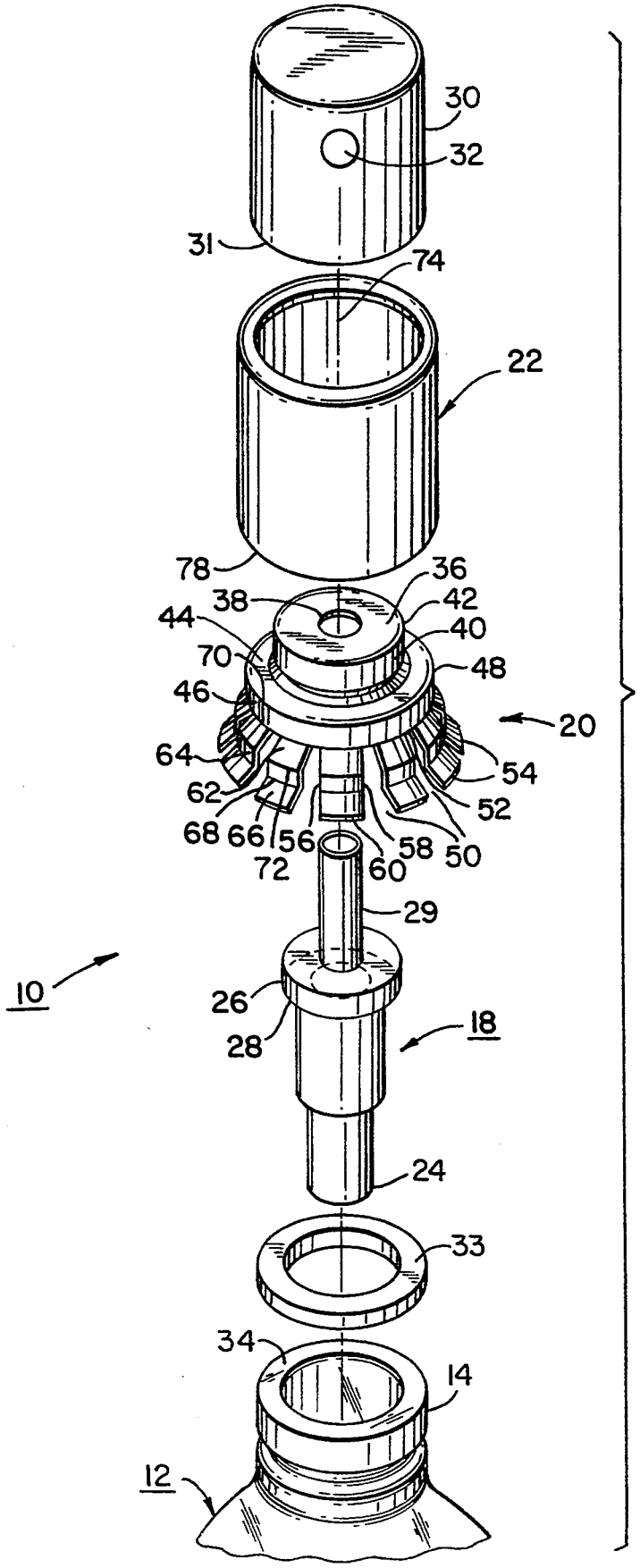
FIG. 1 is an exploded view of the dispenser assembly including the metal finger ferrule of the present invention.

The present invention relates to a metal finger ferrule for damping a dispensing device, such as a finger actuated pump, to a container having a flanged opening. Referring to FIG. 1, an exploded view of a liquid dispensing assembly 10 is shown. The assembly 10 comprises a container 12 having a flanged opening 14, a pump 18, a metal finger ferrule 20 for clamping the dispensing device to the container, a gasket 33, and a retaining collar 22 which provides a supporting surface for the ferrule 20.

The pump 18 is a standard finger actuated type which includes an inlet end 24, a housing 26 having a flanged portion 28 protruding radially outward. The flanged portion 28 provides a clinching surface for holding the pump in place. The pump also includes an actuator 30 having a terminal end 31, and a dispensing outlet 32.

In the embodiment shown in FIG. 1, the ferrule 20 is fabricated from a metal workpiece and includes a first flat circular surface 36 having a central aperture 38 therein. The aperture 38 is dimensioned so as to allow the pump stem 29 of the pump 18 to pass therethrough. The ferrule 20 includes a first skirt portion 40 which extends downwardly from the outer edge 42 of the first flat circular surface 36 to the inner diameter (not shown) of a second flat circular surface 44. A second skirt 46 extends downwardly from the outer edge 48 of the second flat circular surface 44. The outside diameter of the second skirt 46 is dimensioned to be slightly larger than the inside diameter of the retaining collar 22.

When the assembly 10 is in the final assembled state, the pump is held in place by the first flat circular surface 36, the first skirt 40 of the ferrule 20 and the gasket 33. The first skirt 40 provides a clinching action on the flanged portion 28 of the pump 18. The inlet end 24 of the pump 18 is designed so as to be adjacent to the bottom (not shown) of the container 12. Prior to final assembly, the first and second flat circular surfaces 36 and 44 provide surface area for the application of downward pressure on the flexible finger ferrule 20 and gasket 33 as illustrated in FIGS. 2 through 7. It will be appreciated by those skilled in the art that various adaptations of, additions to, or omissions of the first or second flat circular surfaces 36 and 44, and first and second skirts 40 and 46 can be made so as to allow the ferrule 20 to conform to any physical configuration of the pump housing 26, and gasket 33.

The ferrule 20 also includes a plurality of longitudinal slots 50 which are cut into the lower edge portion of the second skirt 46 so as to define a terminal end 52 of the second skirt 46 and a plurality of evenly and circumferentially distributed flexible fingers 54. Each of the flexible fingers 54 include a first edge 56, a second edge 58 and a terminal end 60. Each flexible finger 54 also includes several transverse creases extending from the first edge 56 to the second edge 58. The creases define upper 62, middle 64 and lower portions 66 of the flexible fingers. The lower portion 66 is defined by the terminal end 60 of the flexible finger and a first transverse crease 68 proximal to the terminal end 60. The upper portion 62 is defined by the first edge 56, the second edge 58, a second transverse crease 70 adjacent to the terminal end 52 of the second skirt 46, and a third transverse crease 72 which is between the first and second transverse creases 68 and 70. The middle portion 64 is defined by the first edge 56, the second edge 58, the first transverse crease 68 and the third transverse crease 72. In an alternative embodiment shown in FIG. 8*b*, the first, second and third transverse creases are replaced by a first, second and third transverse gradual bends 68*a*, 70*a* and 72*a* respectively.

Figure 2:
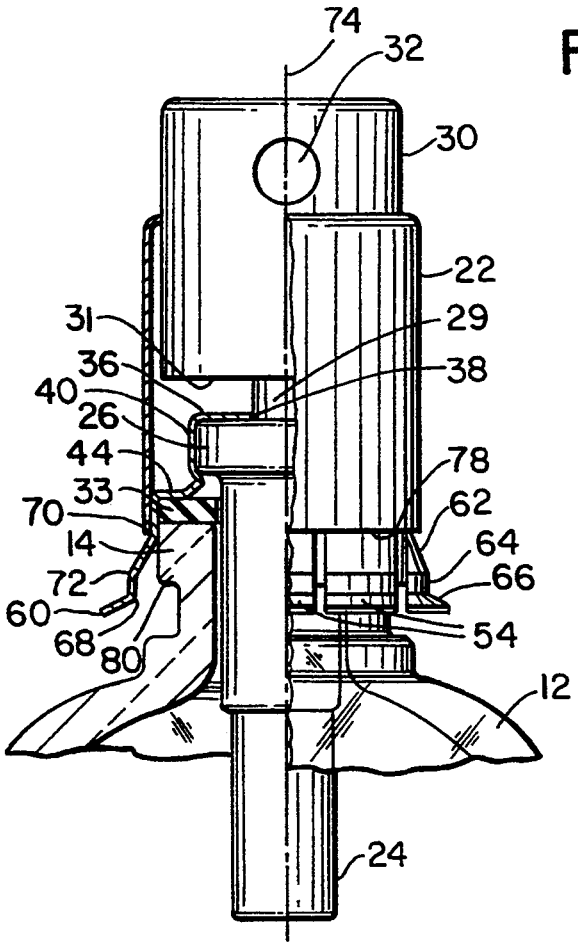
FIG. 2 is a partial axial cross-sectional view of the ferrule and decorative retaining collar of the present invention resting on a flanged container with an upwardly extending actuator prior to assembly.
Figure 7:
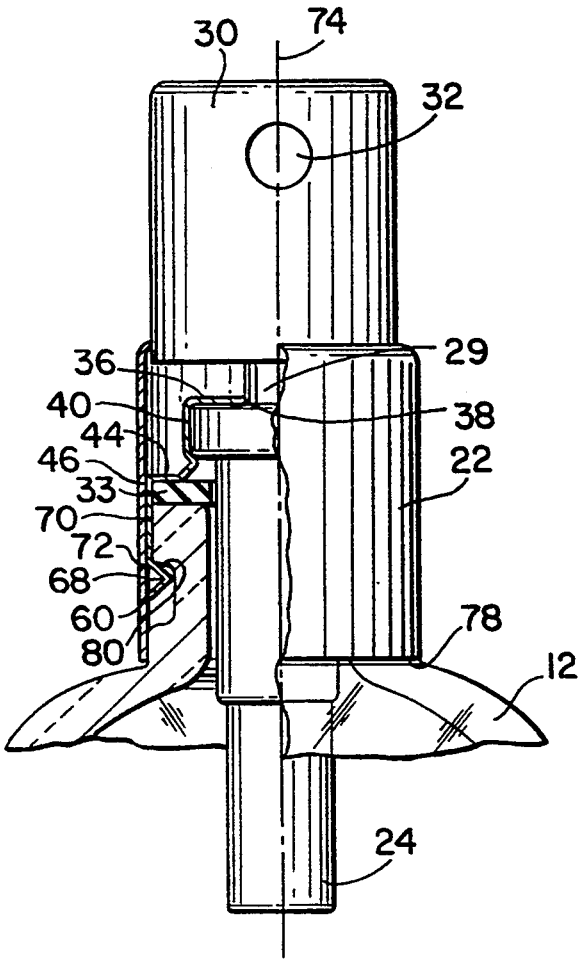
FIG. 7 is a partial axial cross-sectional view of the ferrule and retaining collar after final assembly, with the die members removed.

Referring to FIGS. 2 through 7, the process of attaching the pump 18, ferrule 20 and retaining collar 22 to the container 12 is shown. FIG. 2 specifically shows the flexible finger ferrule 20 within the gasket 33 which is seated on the top 34 of the flanged opening 14 of the container 12. The flexible finger ferrule 20 is attached to the pump housing 26, wherein the pump stem 29 is passed through the aperture 38. The actuator 30 is then connected to the pump stem 29 and the retaining collar 22 is placed over the flexible finger ferrule 20. Prior to final clamping of the ferrule 20 and gasket 33 onto the container 12 by .retaining collar 22, the upper portions 62 of the flexible fingers are inclined from the third transverse bend 72 towards the second transverse bend 70 so as to extend part of the upper portion 62, all of the middle 64 and lower portions 66 of the flexible fingers 54 radially outward past the inside diameter of the metal retaining collar 22. The middle portions 64 of the flexible fingers are substantially parallel to a common central axis 74 running through the assembly 10. Each of the lower portions 66 of the flexible fingers extend radially outward, preferably almost perpendicular to the middle portion 64 and perpendicular to the central axis 74.

Figure 3:
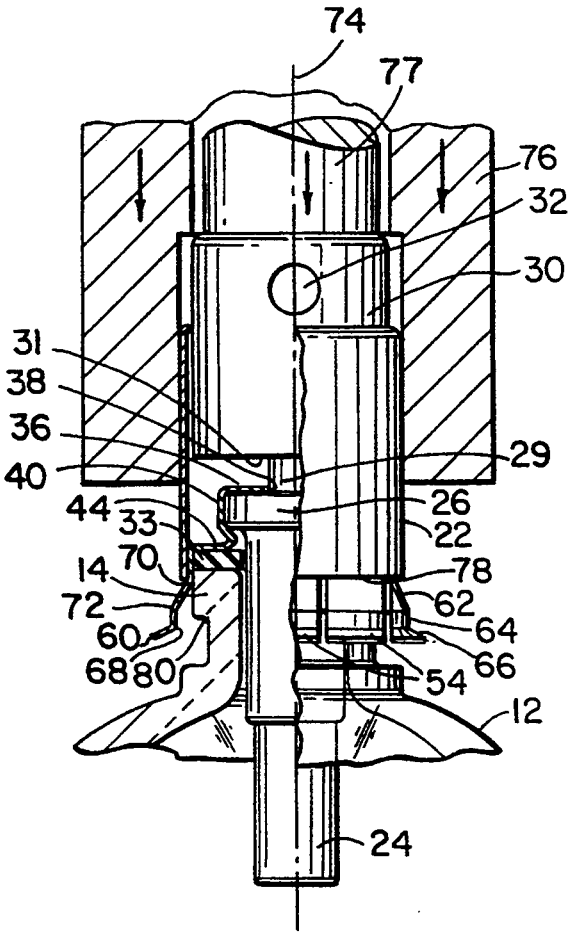
FIGS. 3–6 are corresponding axial cross-sectional views of successive steps in the assembly process, employing concentric inner and outer die members, separately actuated.
Figure 4:
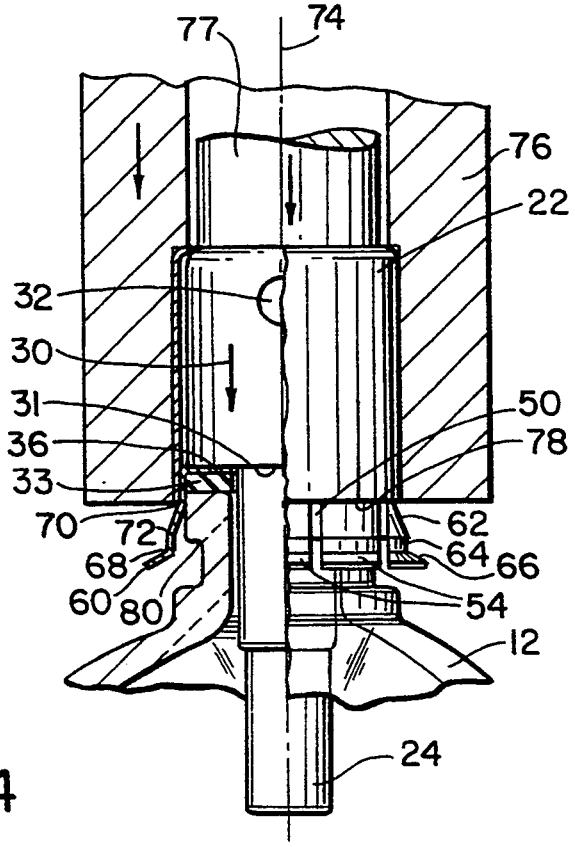
Figure 5:
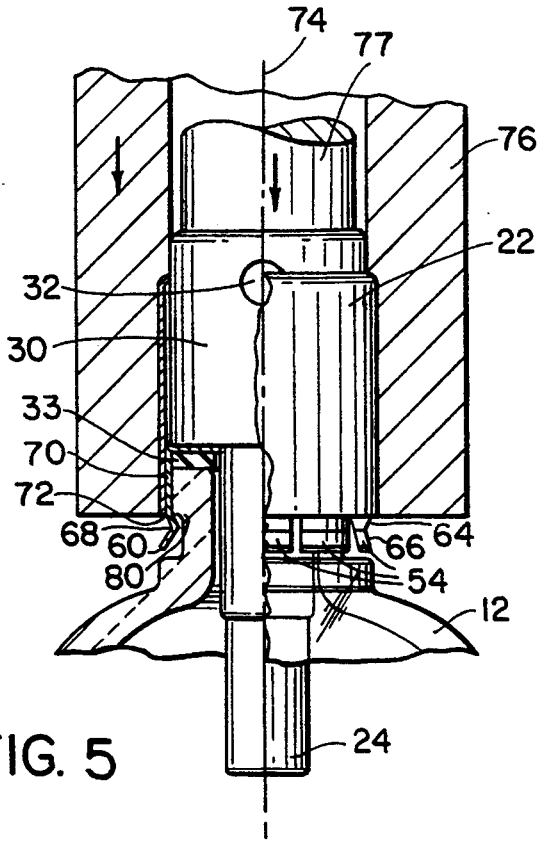
Figure 6:
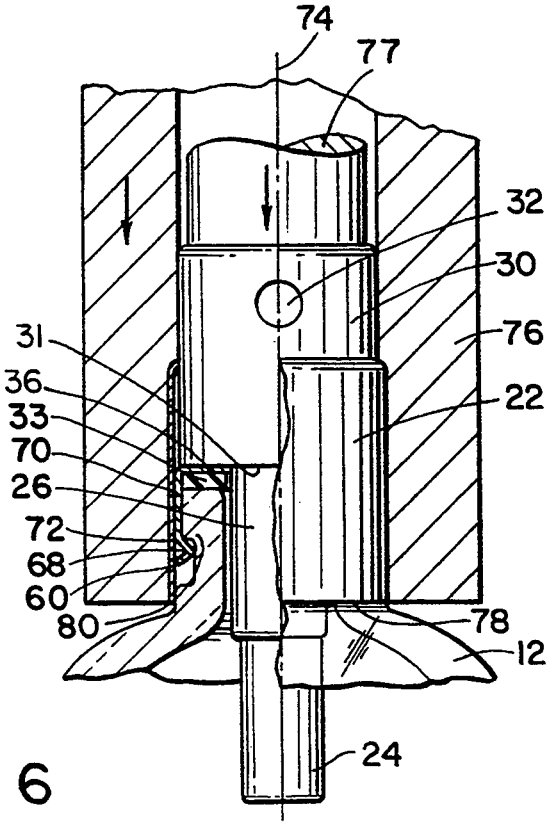

Referring specifically to FIG. 3, a die 75 comprising an outer die member 76 and an inner die member 77 first applies a downward pressure on the actuator 30 until the terminal end 31 of the actuator contacts the second flat circular surface 44. Referring specifically to FIG. 4, the inner die member 77 continues to apply pressure so as to slightly compress the gasket 33 while pressure is applied on the retaining collar 22 by outer die member 76. In this step the outer die member 76 moves in a downward direction relative to inner member 77. From the pressure of the outer member 76 of the die, the inside wall of the retaining collar 22 is forcibly slid along the outside surface of second skirt 46 of the ferrule 20. The second skirt 46 remains in a fixed position relative to the flanged opening 14 of the container because the second flat circular surface 44 rests on the gasket 33 seated on the top 34 of the flanged opening 14 of the container 12.

Because the upper portions 62 of the fingers extend radially outward past the inside diameter of the retaining collar 22, the inside wall of the retaining collar 22 forces each of the upper portions 62 of the flexible fingers 54 inward towards the common central axis 74 as the collar 22 is slid downward. As the upper portions 62 of the flexible fingers 54 are thus forced inward, the middle 64 and lower portions 66 also move inward. During the period when the outer member 76 of the die is causing the collar 22 to slide downward so as to make the collar 22 contact the terminal end 60 of the fingers 54. The sliding motion of the collar 22 may cause temporary bending of the lower portion 66 of the fingers 54 downward with respect to the middle portion 64 so as to temporarily change the perpendicular orientation of the lower portion 66. As the retaining collar 22 is slid further downward by the outer member 76 of the die, the inside wall of the retaining collar 22 slides past the middle 64 and lower portions 66 of each flexible fingers to a final position where its terminal end 78 makes contact with the container 12. When the retaining collar 22 is in its final assembled position, the pressure from the outer and inner members 76 and 77 is removed. In the final assembled position, the retaining collar 22 conceals the entire flexible finger ferrule 20.

Figure 8A:
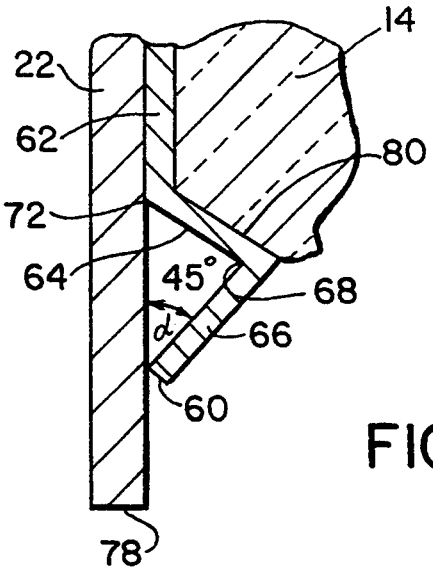
FIG. 8*a* is an enlarged fragmentary cross-sectional view of a tab of the ferrule and the wall of the retaining collar illustrating the positions of the upper, middle and lower portions of the fingers, as defined by the first, second and third sharp creases, relative to the flanged container.
Figure 8B:
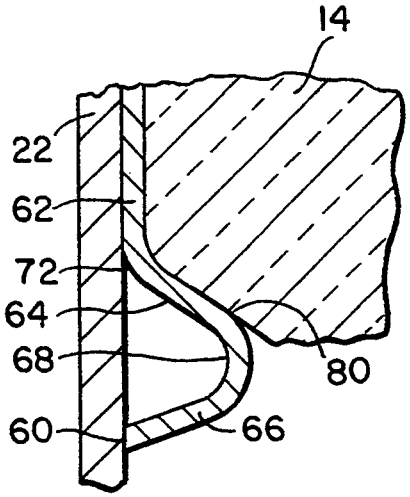
FIG. 8*b* is an enlarged fragmentary cross-sectional view of a tab of the ferrule and the wall of the retaining collar illustrating the positions of the upper, middle and lower portions of the fingers, defined by first, second and third gradual bends rather than creases, relative to the flanged container.
Figure 9:
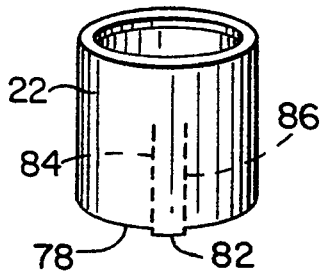
FIG. 9 is an elevational perspective view of a tabbed retaining collar, employed in a modified embodiment of the invention.

FIGS. 8*a* and 8*b* illustrate how the upper 62, middle 64 and lower portions 66 of the flexible fingers 54 act in concert to grasp the lower part 80 of the flanged opening 14 and to hold the retaining collar 22 in place. In the final assembled position, the upper portion 62 of the flexible finger 54 is positioned between the outer surface of the flange 14 and the inner wall of the retaining collar 22. The middle portion 64 of each flexible finger 54 is positioned so as to lie adjacent to the lower part 80 of the flanged opening 14 of the container 12. The middle portion 64 is forced into its position by the lower portion 66, which is forced towards the central axis 74 by the contact of the inner wall of the retaining collar 22 with the terminal end 60 of the flexible finger 54. Because the lower portion 66 of the flexible finger 54 is in a substantially perpendicular orientation with respect to the middle portion 66, the inward movement of the upper portion 62 causes the lower portion 66 to much the inner wall of the retaining collar 22 at an angle $\alpha$ which is greater than or equal to 45 degrees. Because this angle $\alpha$ is greater than or equal to 45 degrees, any attempt to slide the retaining collar 22 in a generally upward direction relative to the container 12 causes the lower portion 66 of the flexible finger 54 to gouge into the inner wall of the retaining collar 22. Thus, an attempt to slide the retaining collar 22 upwardly causes a force to be applied on the end of the lower portion 66 of the flexible finger 54 which in turn causes the lower 66 and middle 64 portions to be forced inwardly towards the central axis 74 and outer surface of the flanged opening 14. Because the flanged opening 14 of the container 12 is rigid, the fingers 54 generally resist any movement inward, thus requiting a great force to remove the collar 22. Therefore, by angling the lower portion 66 of each flexible finger 54 with respect to the middle 64 and upper portions 62 in the above described and shown manner, the flexible finger ferrule 20 is able to lock the retaining collar 22 onto the assembly 10. Of course, if enough upward sliding force is applied to the retaining collar 22, the retaining collar 22 can be removed, but usually at the expense of permanently damaging the flexible fingers 54 of the ferrule or the retaining collar's inside wall. However, this "locking" force applied by the ferrule 20 is usually more than enough to permit normal lifting of the container 12 by the collar 22 without any sliding.

Figure 10:
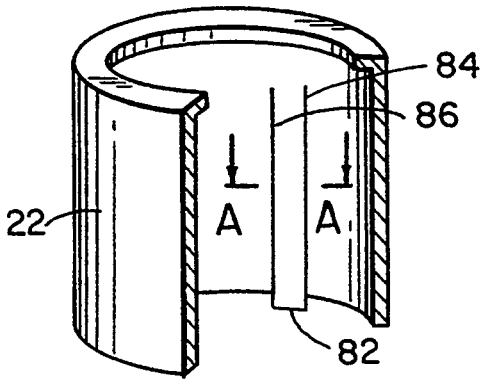
FIG. 10 is an enlarged cutaway perspective rear view of the same tabbed retaining collar having a portion removed so as to expose a pair of grooves on the inner wall of the collar.
Figure 11:
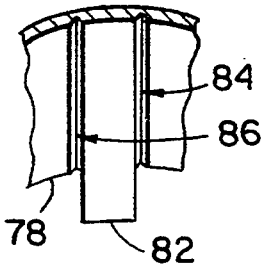
FIG. 11 is a further enlarged fragmentary perspective view of the collar interior showing a section taken along the line A—A of FIG. 10.
Figure 12:
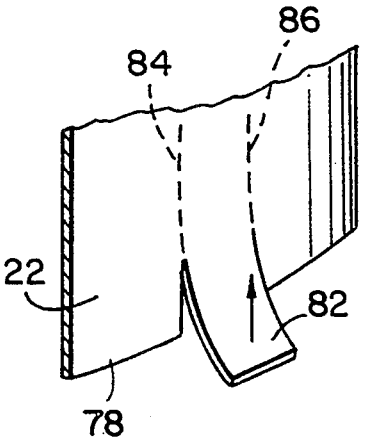
FIG. 12 is a greatly enlarged perspective fragmentary view of the outer diameter of the retaining collar showing the tab partially peeled along the grooves in an upward direction to allow removal of the collar, if needed after product has been used, for recycling of the container.

FIGS. 10 through 12 illustrate a retaining collar 22 having a tab 82 extending downward from the terminal end 78 and a first groove 84 and a second groove 86 extending upwardly from the tab on the inside diameter of the retaining collar 22. When the tab 82 is lifted, it causes the collar 22 to tear along the first and second grooves 84 and 86. The tear compromises the integrity of the retaining collar 22 and, thus, allows the collar 22, ferrule 20, pump 18 and gasket 33 to be removed so that the container 12 may be recycled.

Thus, what has been described is a metal flexible finger ferrule which permits the clamping of a dispensing device to the top of a container having a flanged opening by simple application of pressure to a retaining collar. While the preferred embodiment of the present invention has been described and illustrated, it is understood that the preferred embodiment is capable of variation, addition, omission, and modification without departing from the spirit and scope of the invention.

What is claimed is:

1. A metal flexible finger ferrule for clamping a dispensing device to a container having a flanged opening, said ferrule comprising:

a metal workpiece having:

a circular shaped flat surface having a central aperture therein and an outer diameter;

a cylindrical skirt, said skirt extending perpendicularly downward from said outer diameter of said circular surface, said skirt having a wall defined by an inside and outside diameter;

a plurality of flexible fingers formed by a plurality of circumferentially distributed longitudinal slots cut into said cylindrical skirt, each of said flexible fingers further including:

a terminal end, a first edge and a second edge;

a first transverse bend proximal to said terminal end, said first transverse crease extending from said first edge to said second edge;

a second transverse bend proximal to said cylindrical skirt, said second transverse bend extending from said first edge to said second edge;

a third transverse bend between said first and second transverse bends, said third transverse bend extending from said first edge to said second edge;

an upper portion, said upper portion being defined by said second transverse bend, said first edge, said second edge and said third transverse bend, said upper portion having an inclined orientation with respect to said wall of said cylindrical skirt so as to place said first and third transverse bends at a greater radial distance from a central axis of said cylindrical skirt than the wall of said cylindrical skirt;

a middle portion, said middle portion being define by said third transverse bend, said first edge, said second edge and said first transverse bend, said middle portion having a substantially parallel orientation with respect to said wall of said cylindrical skirt; and a lower portion, said lower portion being defined by said first transverse bend, said first edge, said second edge and said terminal end, said lower portion having a substantially perpendicular orientation with respect to said wall of said cylindrical skirt so as to place said terminal end at a greater radial distance from said central axis than said first and third transverse bends.

2. A metal flexible finger ferrule as described in claim 1 wherein the first, second and third transverse bends are sharp so as to create a first, second and third transverse crease in each of the flexible fingers.

3. An assembly for clamping a dispensing device to a container having a flanged opening, said assembly comprising:

a metal flexible finger ferrule, said ferrule further comprising:

a metal workpiece having:

a circular surface having an aperture therein and an outer diameter;

a cylindrical skirt, said skirt extending perpendicularly downward from said outer diameter of said circular surface, said skirt having a wall defined by an inside and outside diameter;

a plurality of flexible fingers formed by a plurality of circumferentially distributed longitudinal slots cut into said cylindrical skirt, each of said flexible fingers further including:

a terminal end, a first edge and a second edge;

a first transverse bend proximal to said terminal end, said first transverse bend extending from said first edge to said second edge;

a second transverse bend adjacent to said cylindrical skirt, said second transverse bend extending from said first edge to said second edge;

a third transverse bend between said first and second transverse bends, said third transverse bend extending from said first edge to said second edge;

an upper portion, said upper portion being defined by said second transverse bend, said first edge, said second edge and said third transverse bend, said upper portion having an inclined orientation with respect to said wall of said cylindrical skirt so as to place said third transverse bend at a greater radial distance from a central axis of said cylindrical skirt than the wall of said cylindrical skirt;

a middle portion, said middle portion being defined by said third transverse bend, said first edge, said second edge and said first transverse bend, said middle portion having a substantially parallel orientation with respect to said wall of said cylindrical skirt;

a lower portion, said lower portion being defined by said first transverse bend, said first edge, said second edge and said terminal end, said lower portion having a substantially perpendicular orientation with respect to said wall of said cylindrical skirt so as to place said terminal end at a greater radial distance from said central axis than said first and third transverse bends; and a cylindrical retaining collar, said cylindrical retaining collar having a wall defined by an outside and inside diameter, said inside diameter being approximately equal to or smaller than said outside diameter of said cylindrical skirt, whereby said system provides clamping action on said flanged container opening after said collar is slid fully over said ferrule, so that said terminal end of each flexible finger touches the inside diameter of the cylindrical wall of said collar and whereby each lower surface of said flexible finger forms an angle greater than or equal to 45 degrees with respect to the wall of said collar.

4. The assembly of claim 3, wherein said cylindrical retaining collar further includes:

a tab, said tab protruding from a free edge of said retaining collar;

a first groove on said inside diameter of said wall extending centrally away from said tab; and a second groove on said inside diameter extending centrally away from said tab; whereby said tab, and said first and second grooves permit said collar to be tom along said grooves so as to allow the collar to be removed.

5. The assembly of claim 3, wherein said first, second and third transverse bends are sharp so as to create a first, second and third transverse crease in each of the flexible fingers.

* * * * *